United States Patent [19]

Williams et al.

[11] 4,456,184

[45] Jun. 26, 1984

[54] REMOVABLE HEAD ROTARY TOOL FOR FOOD PROCESSORS

[75] Inventors: James E. Williams, Stamford; Edward R. Kozlowski, Southport, both of Conn.

[73] Assignee: Wilson Research & Development, Inc., Greenwich, Conn.

[21] Appl. No.: 274,720

[22] Filed: Jun. 18, 1981

[51] Int. Cl.[3] ..... B02C 18/18

[52] U.S. Cl. ..... 241/92; 83/666; 241/278 R

[58] Field of Search ..... 241/92, 273.1, 273.2, 241/278 R, 282.1, 282.2; 83/355, 356.3, 591, 666

[56] References Cited

U.S. PATENT DOCUMENTS

| | | | |
|---|---|---|---|
| 3,085,607 | 4/1963 | Schottle | 241/92 |
| 3,493,022 | 2/1970 | Mantelet | 241/199.12 |
| 3,892,365 | 7/1975 | Verdun | 241/282.1 X |
| 3,970,258 | 7/1976 | Mantelet | 241/282.1 |
| 4,190,208 | 2/1980 | Schaeffer | 241/92 |
| 4,227,655 | 10/1980 | Williams | 241/92 |
| 4,277,995 | 7/1981 | Sontheimer | 241/92 X |

*Primary Examiner*—Mark Rosenbaum

*Attorney, Agent, or Firm*—Parmelee, Bollinger & Bramblett

[57] ABSTRACT

A horizontal disc-like tool head is detachably mounted on an upper coupling portion of an elongated hub, while a lower coupling portion of the hub is adapted to be coupled to and rotated by the tool drive shaft of a food processor. The tool head has a receptacle underneath it for receiving the upper coupling portion of the hub, which has a flange-like configuration with spaced, projecting, peripheral teeth. The receptacle has a plurality of spaced, lip retainers which are adapted to receive and retain such teeth when the hub is inserted in an axial direction and then rotated about the tool axis for changing its angular orientation in the receptacle. The teeth and lip retainers have corresponding matching sizes, so that the hub properly fits into the receptacle in only one position, thus preventing incorrect insertion of the hub. A spring-loaded receptacle rod protrudes from the upper coupling member, and this retractable rod and its associated locking recess are offset from the axis of tool rotation for preventing removal of the hub from the receptacle, unless the rod is manually retracted by its release button. During manufacture, the receptacles in various tool heads may be provided with different size shims mounted between the receptacle and the lower surface of the tool head for producing slicing tool heads having different slicing thicknesses without changing hub length. Accordingly, one elongated hub can be used with several different tool heads.

24 Claims, 7 Drawing Figures

REMOVABLE HEAD ROTARY TOOL FOR FOOD PROCESSORS

FIELD OF THE INVENTION

This invention relates to rotary food processing tools for food processors, and more particularly to such rotary food processing tools which are provided with removable heads, whereby the parameters and functions of the tool may be varied as desired by the user by positioning removable and interchangeable heads on an elongated hub without requiring the elongated tub or tool shank for each tool head.

BACKGROUND OF THE INVENTION

The present invention is applicable to food processors of the type having a working bowl with a motor driven tool drive means projecting upward into the bowl with which various selected rotary food processing tools can be engaged to be driven for performing various food processing operations in accordance with the desires of the user. A removable cover is secured over the top of the bowl during use. The cover includes a feed tube having a feed passageway which opens downwardly through the cover into the top of the bowl, and food items to be processed are placed in the feed tube and then pushed down through the feed tube into the bowl by means of a removable food pusher which is adapted to slide down in the manner of a plunger through the feed tube. The food items are sliced or otherwise processed by the rotating food processing tool in the top of the bowl.

Additional information with respect to such food processors may be had by reference to U.S. Pat. Nos. 3,892,365—Verdun; 3,985,304—Sontheimer; 4,198,887—Williams; 4,200,244—Sontheimer; 4,216,917—Clare & Sontheimer; 4,213,570—Jones; 4,226,373—Williams; and 4,227,655—Williams.

Of particular interest to the present invention are rotary food processing tools which are used for slicing, dicing, cutting, rasping, grating, and for making French fry slices or julienne slices and the like from food items, such as potatoes, onions, carrots, cucumbers, celery, cabbage, squash, etc. Such rotary food processing tools have a horizontal disc-like member formed of sheet metal, preferably of stainless steel, which is mounted on an elongated hub extending down in the bowl of the food processor and which is coupled near its lower end to motor-driven tool drive means. A horizontal cutting blade or other cutting or grating or rasping structure is associated with the horizontal disc-like member such that when items are cut they pass through one or more openings in the disc-like member into the bowl. The type of food processing which is performed by a rotary tool is determined by the type of cutting structure on the disc, the spacing and elevation of the cutting edges, the nature of the top surface of the disc, etc.

In the prior art, in order to change the parameters or the particular cutting function of a rotary food processing tool, the entire tool is removed from the bowl and replaced by another entire tool. Accordingly, a multiplicity of separate tools each having an elongated hub and a flat horizontal disc-like member are kept on hand for performing different types of food processing operations. The elongated hub or shank projecting from each disc-like member of the respective rotary tools may cause a storage problem in crowded kitchens with little storage space, when there is a need for having on hand a multiplicity of individual rotary tools of different types. One solution to this problem is disclosed in copending application Ser. No. 274,719 which is assigned to the assignee of the present invention. This application is to another preferred embodiment.

SUMMARY OF THE INVENTION

Accordingly, it is an object of this invention to provide a new and improved rotary food processing tool in which the parameters and functioning of such tools can be varied without replacing the entire tool.

A further object of this invention is to provide a new and improved rotary food processing tool which may provide a plurality of food processing functions by conveniently mounting a removable disc-like head on the elongated hub of the tool.

Among the advantages of the present invention are those resulting from the fact that this invention provides a new and improved rotary food processing tool in which a plurality of removable disc-like heads are easily mounted upon or removed from the shank or hub of the rotary tool, thereby varying the parameters and functioning of the rotary food processing tool without requiring an individual shank for each tool.

Still a further advantage of this invention is in the provision of a new and improved rotary food processing tool assembly for a food processor which enables the use of a single elongated hub or shank for different cutter heads, thereby providing a plurality of disc-like tool heads which may be stored relatively compactly.

In carrying out this invention in one illustrative embodiment thereof, a removable head rotary food processing tool is provided for use in a food processor of the type having an upright working bowl in which the rotary tool is mounted for rotation therein by a motor drive means. There is a removable cover secured to the bowl for covering the bowl and the rotary tool, and a feed tube for feeding food items to the rotary tool in the bowl. The removable tool head has an elongated hub shank having an upper head coupling portion and a lower drive coupling portion adapted to be coupled to and rotated by the motor drive means. A horizontal disc-like tool head includes a disc-like member having a cutting structure thereon for processing food items applied thereto. The processed food items are directed through the cutting structure into the bowl. This disc-like tool head is removably mountable onto the upper coupling portion of said elongated hub, whereby other disc-like tool heads having different cutting structures for performing different food processing functions may be mounted on the same hub conveniently by changing heads without requiring a separate hub for each rotary tool. Manually releasable locking means are provided for preventing release of the tool head from the hub during operation.

Among the many advantages of the present invention are those resulting from the fact that a single elongated hub or shank may be used for performing food processing operations simply by quickly and easily detachably mounting in locking engagement on the upper coupling portion of the hub various removable disc-like heads having different cutting structures. Since the horizontal disc-like tool heads, with the elongated hub detached, are relatively flat, they take up considerably less space, for example, when stored in a kitchen drawer, and are convenient to store in a stack one on top of another, rather than providing entire, separate rotary food processing tools for each operation to be performed at various times by the food processor.

The tool head includes a socket receptacle on its underside, which comprises a plurality of spaced, lip retainers separated by a plurality of clearance notches. The upper coupling member has a plurality of spaced peripheral teeth extending therefrom which are adapted to fit into the notches between the lip retainers such that when the hub is axially inserted into the receptacle and then rotated relative to the tool head, the teeth become captured in the ledge retainers. A spring-loaded rod protruding from the hub and an associated locking recess in the receptacle are positioned off-center from the axis of rotation of the rotary tool for preventing removal of the hub from the tool head unless a release button attached to the rod is depressed for withdrawing the rod from its associated locking recess. By virtue of this receptacle, engagement between the tool head and the hub, they are securely and firmly attached for preventing or misalignment of the tool head as a result of stresses imposed during the processing of various food items.

BRIEF DESCRIPTION OF THE DRAWINGS

The invention, together with further aspects, objects, features and advantages thereof, will be more clearly understood from a consideration of the following description taken in conjunction with the accompanying drawings in which like elements are designated with the same reference numerals.

DESCRIPTION OF THE PREFERRED EMBODIMENTS

Figure 5:
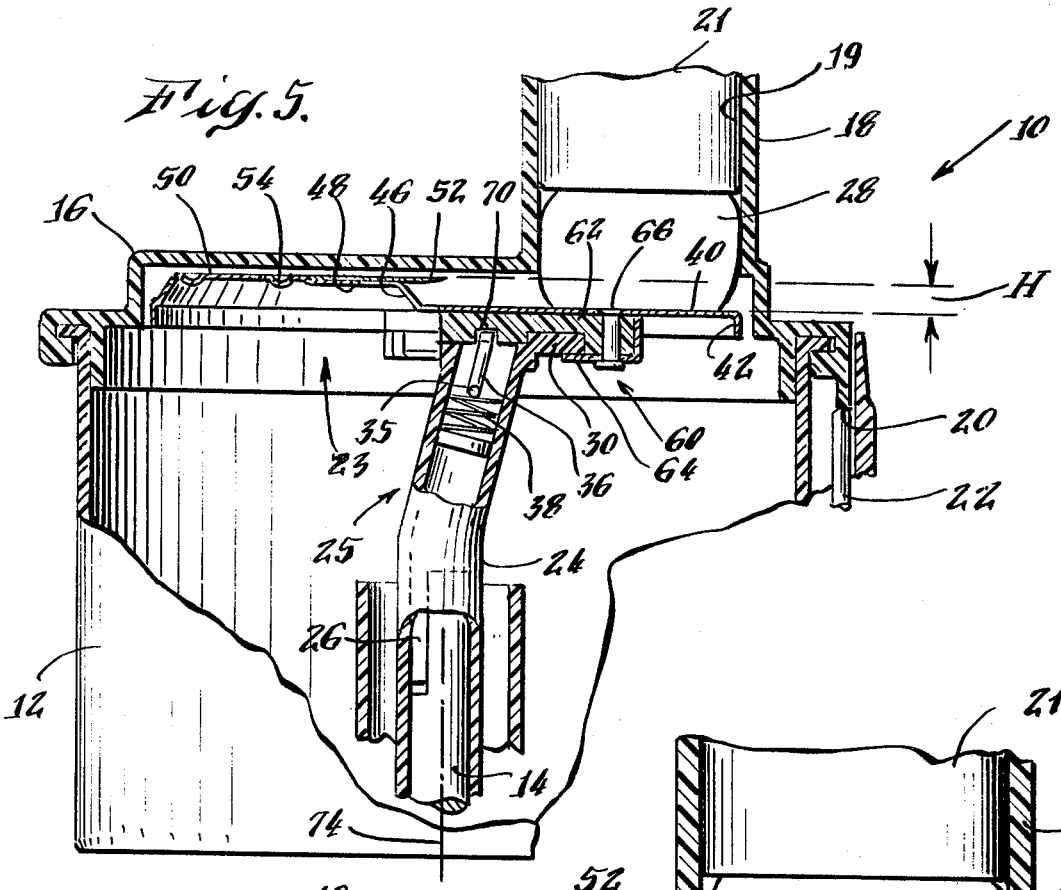
FIG. 5 is a sectional, elevational view of FIG. 1 illustrating the removable head rotary tool being mounted in the bowl of a food processor with the cover positioned thereon.

Before describing in detail the removable head rotary tool, reference is first made to FIG. 5 which illustrates a portion of a food processor, indicated generally with the reference numeral 10. The food processor 10 includes an upright working bowl 12 with a motor driven tool drive means 14 in the form of a shaft extending up into the bowl. A removable cover 16 having a feed tube 18 extending through the cover closes the bowl 12. At the same time, a cam surface 20 on the cover 16 depresses an actuator rod 22 which closes a switch to enable operation of drive means (not shown) for driving the tool shaft 14. The feed tube 18 provides a feed passageway 19 for introducing food to be processed into the working bowl 12. A removable pusher 21 is adapted to slide down into the feed tube 18 for pushing a food item 28 against the rotary processing tool.

The rotary food processing tool, referred to generally with the reference numeral 25, includes a disc-like tool head 23 which is positioned near the cover 16 and has an elongated hub 24 with lower coupling means 26, for example such as a key or spline on the lower end of the elongated hub which is coupled to the motor-driven tool drive means 14 for rotating the tool 25. The upper end of the elongated hollow hub 24 carries a ledge-like upper coupling flange member 30 having a plurality of teeth 32 protruding from its periphery, which are separated by circumferential notches 34. The function of this upper head coupling member 30 will be described hereinafter.

The upper end of the elongated hub 24 houses a spring-loaded rod 36 with a spring 38 which urges the rod upwardly, such that it protrudes out of the upper end of the hub 24. A manual release button 35 is attached to this rod which is adapted to retract the rod inward into the bore of the hub to release it from its locking engagement with the removable head in a manner to be described hereinafter.

Figure 1:
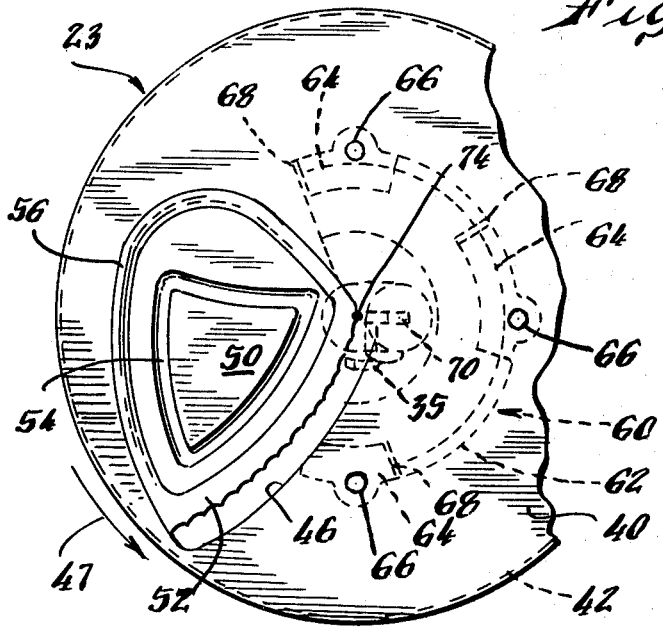
FIG. 1 is a top view of one type of rotary food processing tool embodying the present invention.

The rotary food processing tool 25 illustrated in FIGS. 1 and 5 has a removable head 23 including a slicing structure. The slicing structure is described merely for illustrating purposes but it will be appreciated that removable tool heads having other forms of cutting structures, such as graters, raspers, julienne and French fry cutters, etc., may be employed in practicing the present invention.

As will be seen in FIGS. 1 and 5, the tool head 23 includes a horizontal disc-like member 40 of stainless steel having an opening 46 formed in its horizontal surface. This opening 46 extends from a region near the axis of rotation 74 out toward the depending peripheral skirt 42 on the disc-like member 40. The tool 25 rotates in a counterclockwise direction as shown by the arrow 47. The region behind the opening 46 is pressed upwardly to form an elevated platform 50 having a front lip 48. This lip 48 carries an arcuate hardened steel slicing blade 52 which is fastened in place by spot welding. The slicing blade 52, which is illustrated as having a slightly scalloped or serrated cutting edge projects forwardly partially over and above the arcuate opening 46. The elevated platform 50 has downwardly embossed strengthening ribs 54 and a gradually downwardly sloping rear shoulder 56 extending around behind the elevated platform 50. The configuration of the platform 50 is to facilitate the slicing of food items being processed by the food processor 10. As the items are sliced they will pass through the slot 46 into the bowl 22 with as little interference as possible from the sloping shoulder 56 of the platform 50, as described and claimed in the Sontheimer U.S. Pat. No. 4,200,244.

As is indicated on the right hand portion of FIG. 5, the thickness H of the slice is determined by the vertical distance between the slicing blade 52 and the horizontal member 40.

Figure 3:
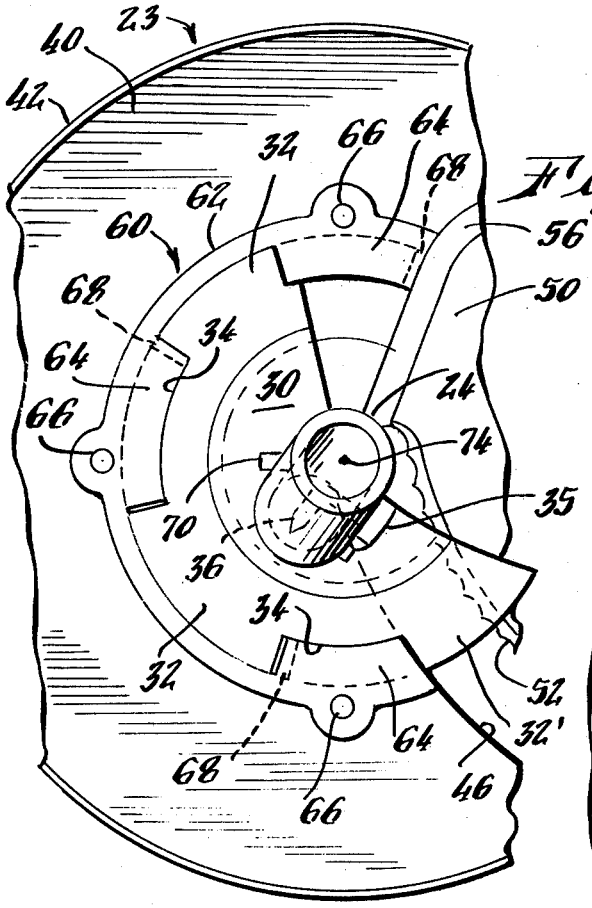
FIG. 3 is a bottom view of the removable head rotary tool shown in FIG. 1 with the hub shown being positioned in the receptacle on the underside of the movable head.
Figure 4:
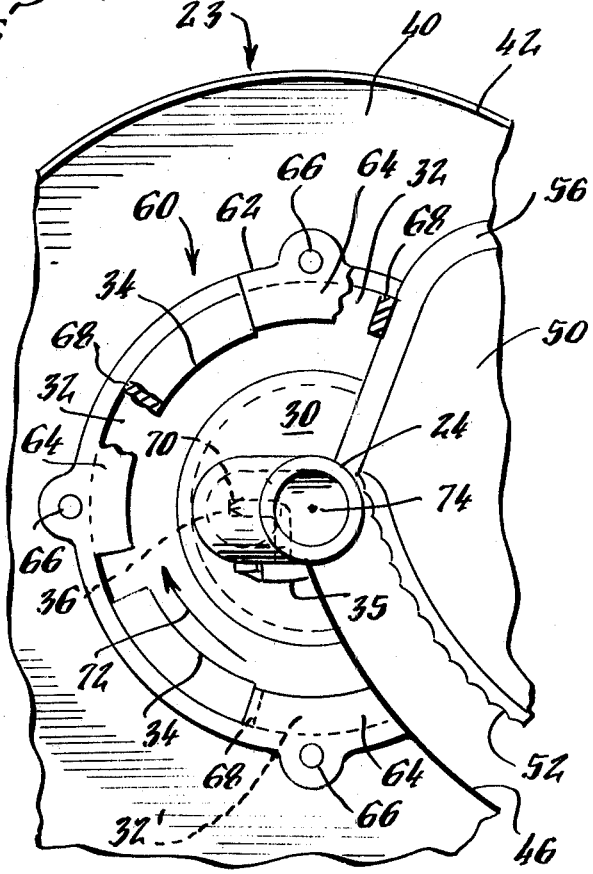
FIG. 4 is a bottom view similar to FIG. 3 showing the elongated hub with its flange-like coupling member rotated and located in fixed position in the receptacle on the underside of the removable head of the rotary tool.

Referring now to FIGS. 3–5, receptacle means, referred to generally with the reference character 60, is provided on the underside of horizontal member 40 of the removable head 23 which provides a means for detachably mounting the removable tool head 23 on the elongated hub 24. The receptacle 60 has a slightly larger than semi-circular base 62 with a plurality of spaced lip retainers 64 mounted thereon by rivets 66 attached to the horizontal member 40. Each lip retainer 64 is open at one end and has a stop 68 positioned on the opposite end for limiting the relative turning movement of the hub and for capturing the teeth 32 of the upper coupling member 30 in engagement with the lip retainers 64. The base 62 also has a locking recess 70 which is adapted to capture and retain the end of the spring-biased retractable locking rod 36.

It is to be noted that the lip retainers 64 are unevenly spaced; in other words, they are not symmetrically, circumferentially spaced, and that such spacing corresponds accurately with the circumferential spacing and size of the teeth 32 on the upper coupling member 30. This correspondence is very helpful to the user in that the upper coupling member 30 can consequently only be inserted into the receptacle means 60 in a single position, thus preventing the user from inadvertently attempting to mount the removable head 23 in an incorrect position on the hub 24.

Figure 2:
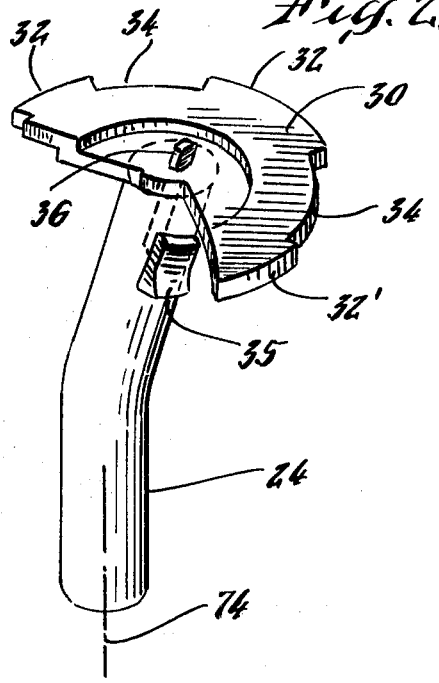
FIG. 2 is a perspective view of an elongated hub of the type utilized in the present invention illustrating the ledge-like flange upper coupling member having peripheral teeth and which is adapted to have the removable head of the rotary tool mounted thereon.

In use in order conveniently to mount the removable tool head 23 on the hub, the head is placed face down with the receptacle means 60 thereby being exposed. The flange-like upper coupling member, as shown in FIG. 2, is inverted and is inserted by the user into the receptacle means such that the teeth 32 are inserted into the clearance recesses separating the lip retainers 64. Since the spacing of the lip retainers and the spacing of the teeth 32 on the upper coupling member are each spaced unevenly in the same manner, proper alignment between the spaced teeth and the clearance recesses between the lips permits the insertion of the upper coupling member into the receptacle means 60 in only one position as is illustrated in FIG. 3.

The hub 24 is then rotated in the direction shown by the arrow 72 on FIG. 4 thereby turning the teeth into engagement with the spaced lip retainers 64 until the respective teeth contact the stops 68. At this angular position of the hub relative to the tool head, the spring-loaded rod 36 comes into alignment with and projects into and is held in the locking recess 70 in the base 62. It is to be noted that the rod 36 is located in the bore of the upper portion of the elongated hub but this rod 36 is not in the axis of rotation 74 of the tool 25. Accordingly, once the rod 36 is in alignment with and enters the locking recess 70 in the base of the receptacle means 60, the removable tool head 23 can no longer be removed from the hub 24 unless the rod 36 is manually released.

Therefore, the release button 35 must be actuated by the user to retract the rod 36 from the locking recess 70 in the base 62 in order to remove the tool head 23 from the hub 24. Thus, the combination of the non-symmetrical spacing of the lip retainers and the teeth 32 along with the operation of the locking rod 36 provides a positive, fail-safe alignment and locking relationship between the removable head 23 and the hub 24.

As is illustrated in FIG. 5, the removable tool head 23 is detachably mounted on a dog-leg shank of the hub 24 such that the axis of the rotation 74 of the rotary tool 25 is offset from the region where the removable tool head 23 is joined or mounted on the hub 24. This is a preferred form of tool construction for the reasons described in U.S. Pat. No. 4,227,655 referred to above. However, the present invention is not limited to the offset hub, but is equally applicable to rotary tools with a hub which is aligned with the axis of rotation of the tool in the food processor 10. However, in such an embodiment in order to achieve the locking benefits of the rod 36, this rod is positioned off axis on the upper end of the hub 24.

The periphery of the flange-like coupling member 30, including its circumferentially spaced teeth 32, is concentric with the axis of rotation 74. Thus, the receptacle means 60 is concentrically mounted on the horizontal member 40 of the tool head 23. Consequently, when the coupling member is rotated into its fully engaged position in the receptacle, it is turned about the axis of rotation, but the locking rod 36 and recess 70 are offset from this axis of rotation for locking the hub 24 against rotation relative to the tool head 23. The stops 68 are located to receive the thrust of the teeth 32 resulting from the torque applied to the hub 24 by the tool drive means 14.

As mentioned further above, the base 62 extends around the axis of rotation more than a semi-circle. In this embodiment, the angular extent of the receptacle base 62 is 225°, and the angular extent of the flange-like member 30 on the upper end of the hub is correspondingly 225°, including three teeth 32 and two circumferential notches 34 between neighboring teeth.

In accordance with the present invention, a plurality of removable heads 23 each having receptacle means 60 thereon will be provided, each of which has a different cutting structure for performing different food processing operations. Thus, a single hub may be utilized with a plurality of rather flat removable heads instead of having to provide each head with its own shank.

Figure 6:
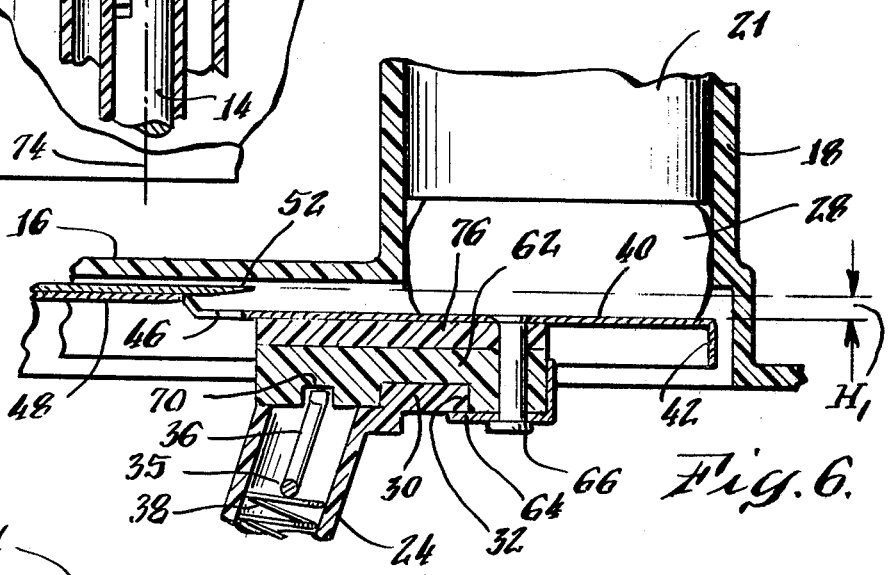
FIG. 6 is a partial cross-sectional view similar to FIG. 5 illustrating a reduction in the size of the slice made by the cutting tool in accordance with another aspect of this invention.

In FIG. 5 the distance H representing the thickness of a slice is determined by the vertical spacing of the blade 52 from the horizontal member 40. In FIG. 6 the distance between the blade 52 and the horizontal member 40 is represented by $H_1$, which is smaller than H thereby providing a thinner slice. This result is accomplished in FIG. 6 by inserting a shim 76 between the base 62 of the receptacle means 60 and the bottom of the horizontal member 40.

Figure 7:
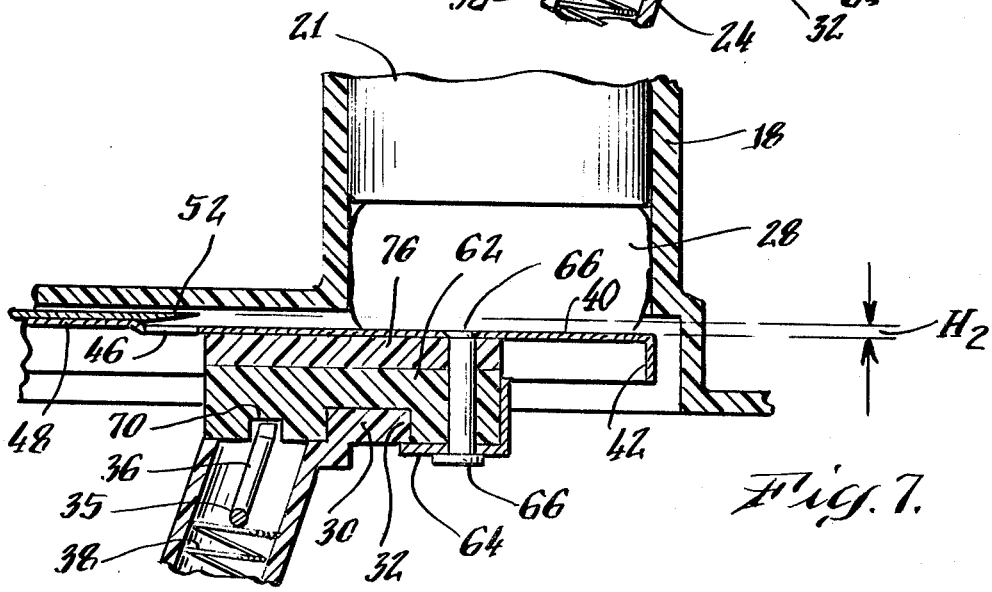
FIG. 7 is a side elevational cross-sectional view similar to FIGS. 5 and 6 showing a smaller slice being made by adding a thicker shim to the socket receptacle construction.

In a similar fashion in FIG. 7 the distance $H_2$ is achieved, representing yet a thinner slice, by providing a thicker shim 76 between the base 62 and the underside of the member 40. In other words, the removable heads 40 may be readily manufactured to perform different slicing functions, for example, thinner or thicker slices, simply by varying the thickness of a shim inserted between the base of a receptacle means and the underside of the member 40 without changing the length of the hub 24.

As further assurance against the user attempting incorrect insertion of the hub into the receptacle, the last tooth 32' may have a slightly greater radial length than the others, and the region of the receptacle which receives the tooth 32' has a slightly greater radial clearance for such a longer tooth.

Among the advantages of this removable head tool is the convenience in storing the removable tool heads each of which has a generally flat disc-like overall configuration. The rather flat overall configuration of the removable heads permits the various removable heads to be stored compactly and requires only one elongated hub 14 for all of the tool heads.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A removable head rotary tool for use in food processors of the type having an upright working bowl in which said rotary tool is mounted for rotation about an axis within said bowl by motor drive means, a removable cover securable on said bowl for covering said bowl and said rotary tool during operation and a feed tube for feeding food items to said rotary tool in said bowl, said removable head rotary tool comprising:

an elongated hub having a flange-like upper coupling member and a lower coupling portion adapted to be coupled to and rotated by said motor drive means, said flange-like upper coupling member has a plurality of circumferentially spaced teeth extending radially from its periphery, a horizontal disc-like tool head cutting means thereon for processing food items applied to said tool head, receptacle means on the lower surface of said tool head, said receptacle means being open in the axial direction for accommodating the insertion of said flange-like upper coupling member in the axial direction into said receptacle means with limited rotational movement of said flange-like upper coupling member therein for removably mounting of said tool head on said flange-like upper coupling member of said hub by aligning and turning said flange-like upper coupling member in said receptacle means, said receptacle means has a plurality of spaced clearance recesses open in the axial direction for receiving said spaced teeth of said flange-like upper coupling member inserted in the axial direction therein, said receptacle means having retainer lips between said clearance recesses, said spaced teeth being insertable in the axial direction into said clearance recesses, and said flange-like upper coupling member being turnable within said receptacle after axial insertion therein for becoming captured in said receptacle means when said spaced teeth are turned in said receptacle means for moving said spaced teeth into snug engagement in said receptacle above said retainer lips, whereby other disc-like tool heads having different cutting structures for performing different food processing functions may be used on the same hub by changing tool heads without requiring a separate hub for each rotary tool.

2. The removable head rotary tool set forth in claim 1 in which:

said spaced teeth and said spaced clearance recesses are each spaced unevenly in the same manner, whereby proper alignment between the uneven spaced teeth and uneven spaced recesses is required before insertion for preventing the incorrect insertion of said upper coupling member into said receptacle means.

3. The removable head rotary tool set forth in claim 1, in which:

said retainer lips each having a stop on their corresponding ends for limiting the circumferential turning movement of said spaced teeth as they are turned into engaged position with said retainer lips.

4. The removable head rotary tool set forth in claim 3, in which: said retainer lips and said spaced teeth are unevenly spaced with the same spacing arrangement for preventing the improper insertion of said upper coupling member into said receptacle means.

5. The removable head rotary tool set forth in claim 3, in which:

said stops are positioned on the respective ends of said retainer lips toward which said teeth are driven by the torque applied to said hub by said tool drive means.

6. A removable rotary tool for use in food processors of the type having an upright working bowl in which said rotary tool is mounted for rotation about an axis within said bowl by motor drive means, a removable cover securable on said bowl for covering said bowl and said rotary tool during operation and a feedtube for feeding food items to said rotary tool in said bowl, said removable head rotary tool comprising:

an elongated hub having an upper flange-like coupling member and a lower coupling portion adapted to be coupled to and rotated by said motor drive means, said flange-like upper coupling member has a plurality of spaced teeth extending from its periphery, and a horizontal disc-like tool head having cutting means thereon for processing food items applied to said tool head, receptacle means on the lower surface of said tool head, said receptacle means being open in the axial direction for accommodating the insertion of said flange-like coupling member in the axial direction into said receptacle means with limited rotational movement of said flange-like coupling member therein for removably mounting said tool head on said flange-like coupling member of said hub by aligning and turning said flange-like coupling member in said receptacle means, said receptacle means having a plurality of spaced clearance recesses for receiving said spaced teeth, with spaced lip retainers between said clearance recesses, such that said spaced teeth are captured in said receptacle means when said teeth are aligned in said spaced recesses and turned into said receptacle means for moving said teeth into snug engagement with said lip retainers, said lip retainers each having a stop on their corresponding ends for limiting the circumferential movement of said spaced teeth as they are turned into engaged position with said lip retainers, and locking means for holding said teeth against the respective stops for preventing inadvertent removal of the tool head from the hub during operation, whereby other disc-like tool heads having different cutting structures for performing different food processing functions may be used on the same hub by changing tool heads without requiring a separate hub for each rotary tool.

7. The removable head rotary tool set forth in claim 6, in which:

said locking means includes a locking recess in said receptacle means offset from the axis about which said flange-like member is turned into said receptacle, and a manually retractable rod located in a bore in the upper end of said elongated hub, and the upper end of said rod being moved into said locking recess by spring means in said hub when said flange-like member is turned into its fully inserted position in said receptacle means with the respective teeth overlying the respective lip retainers and being adjacent to the respective stops.

8. The removable head rotary tool set forth in claim 6 in which:

said lip retainers and said spaced teeth are unevenly spaced with the same spacing arrangement for preventing the improper insertion of said coupling member into said receptacle.

9. The removable head rotary tool set forth in claim 6 in which:

said stops are positioned on the respective ends of said lip retainers toward which said teeth are driven by the torque applied to said hub by said tool drive means.

10. A removable rotary tool for use in food processors of the type having an upright working bowl in which said rotary tool is mounted for rotation about an axis within said bowl by motor drive means, a removable cover securable on said bowl for covering said bowl and said rotary tool during operation and a feed-tube for feeding food items to said rotary tool in said bowl, said removable head rotary tool comprising:

an elongated hub having an upper flange-like coupling member and a lower coupling portion adapted to be coupled to and rotated by said motor drive means, said flange-like upper coupling member has a movable rod extending upwardly therefrom, said movable rod being offset from the axis of rotation of said rotary tool, a horizontal disc-like tool head having cutting means thereon for processing food items applied to said tool head, and receptacle means on the lower surface of said tool head, said receptacle means being open in the axial direction for accommodating the insertion of said flange-like coupling member in the axial direction into said receptacle means with limited rotational movement of said flange-like coupling member therein for removably mounting said tool head on said flange-like coupling member of said hub by aligning and turning said flange-like coupling member in said receptacle means, and said receptacle means has an upwardly extending locking recess therein offset from said axis adapted to receive said movable rod when said upper coupling member is properly positioned in said receptacle means, thereby preventing the inadvertent removal of said removable head from said hub when the end of said rod is in said locking recess, whereby other disc-like tool heads having different cutting structures for performing different food processing functions may be used on the same hub by changing tool heads without requiring a separate hub for each rotary tool.

11. In a rotary tool for use in a food processor, said rotary tool having an elongated hub whose lower end is adapted for engagement with tool drive means in the food processor and whose upper end carries a generally horizontal disc-like member having food processing means thereon, the improvement comprising:

a tool head having an axis of rotation including said disc-like member and receptacle means including a base secured to said disc-like member defining a relatively flat shallow socket having an axially open entrance and said flat shallow socket extending radially outwardly below said disc-like member, and said socket extending around the axis of tool rotation more than a semi-circle and less than a full circle, said socket including a plurality of spaced lips extending inwardly immediately below the level of said socket, said elongated hub being removably mountable to said tool head by insertion into said socket, the upper end of said elongated hub including a flat flange projecting out radially therefrom having a plurality of circumferentially spaced radially projecting teeth on its periphery, and said flat flange being insertable axially into said entrance and thereafter being turnable in said socket with said teeth becoming snuggly engaged above said lips.

12. In a rotary tool for use in a food processor, the improvement as claimed in claim 11, in which:

during mounting of the hub in said tool head said flange is turnable in said socket in the direction about the axis of rotation of the rotary tool toward which said flange is driven by the torque applied to said hub by said tool drive means during operation of the food processor.

13. In a rotary tool for use in a food processor, the improvement as claimed in claim 11, in which:

said spaced lips are unevenly spaced and said spaced teeth are of uneven size for assuring that the user inserts the hub into the receptacle in the correct position.

14. In a rotary tool for use in a food processor, said rotary tool having an elongated hub whose lower end is adapted for engagement with tool drive means in the food processor and whose upper end carries a generally horizontal disc-like member having food processing means thereon, the improvement comprising:

a tool head including said disc-like member and means secured to said disc-like member defining a receptacle having an entrance below said disc-like member, said receptacle defining means including a plurality of spaced lips extending inwardly immediately below the level of said receptacle, said elongated hub being removably mountable to said tool head, the upper end of said hub including a flange projecting out horizontally therefrom having a plurality of spaced teeth on its periphery, said flange being insertable into and turnable in said receptacle with said teeth snuggly engaging above said lips when fully inserted into said receptacle, and manually releasable locking means for locking the upper end of said hub into said receptacle for preventing removal during operation.

15. In a rotary tool for use in a food processor, the improvement as claimed in claim 14, in which:

said manually releasable locking means is a longitudinally movable rod located in a bore in said elongated hub, and spring means in said bore urge said rod upwardly in said bore, the upper end of said rod engaging said receptacle means offset from the rotational axis for locking said tool head onto said hub.

16. In a rotary tool for use in a food processor said rotary tool having an elongated hub whose lower end is adapted for engagement with tool drive means in the food processor and whose upper end carries a generally horizontal disc-like member having food processing means thereon, the improvement comprising:

a tool head including said disc-like member and means secured to said disc-like member defining a receptacle having an entrance below said disc-like member, said receptacle defining means including a plurality of spaced lips extending inwardly immediately below the level of said receptacle, said elongated hub being removably mountable to said tool head, the upper end of said hub including a flange projecting out horizontally therefrom having a plurality of spaced teeth on its periphery, said flange being insertable into and turnable in said receptacle with said teeth snuggly engaging above said lips when fully inserted into said receptacle, and locking means for preventing said flange from turning in said receptacle when said teeth are snuggly engaged above said lips for preventing dislodging of the tool head from the hub during operation of the food processor.

17. In a rotary tool for use in a food processor, said rotary tool having an elongated hub whose lower end is adapted for engagement with tool drive means in the food processor and whose upper end carries a generally horizontal disc-like member having food processing means thereon, the improvement comprising:

a tool head including said disc-like member and means secured to said disc-like member defining a receptacle having an entrance below said disc-like member, said receptacle means including a plurality of spaced lips extending inwardly immediately below the level of said receptacle, an elongated hub removably mountable to said tool head, the upper end of said hub including a flange projecting out horizontally therefrom having a plurality of spaced teeth on its periphery, said flange being insertable into and turnable in said receptacle with said teeth snuggly engaging above said lips when fully inserted into said receptacle, said flange during the mounting of said hub in said tool head being turnable in said socket in the direction about the axis of rotation of the rotary tool toward which said flange is driven by the torque applied to said hub by said tool drive means during the operation of the food processor, and manually releasable locking means engaged between the hub and the tool head for preventing the tool head from turning relative to the hub during operation of the food processor.

18. In a rotary tool having an elongated hub whose lower end is adapted for engagement with tool drive means in a food processor and whose upper end carries a generally horizontal disc-like member having food processing means thereon, said tool being rotated about an axis of rotation by said tool drive means during operation of the food processor, the improvement comprising:

a removable tool head including the disc-like member and receptacle means defining a receptacle having an entrance below said disc-like member, said receptacle means including a plurality of radially extending recesses communicating with said entrance and each having inwardly facing surfaces concentric with the axis of rotation, said elongated hub being removably mountable to said tool head, the upper end of said hub including a plurality of radially outwardly projecting circumferentially spaced teeth whose outwardly facing surfaces are each concentric with the axis of rotation, the upper end of said hub being axially insertable into said entrance with said outwardly projecting teeth entering the respective recesses with the outwardly facing surface of each tooth near the inwardly facing surface of its recess, the hub after having been fully axially inserted being turnable relative to the tool head about the axis of rotation for turning said teeth into engagement in the receptacle.

19. In a rotary tool for use in a food processor, the improvement as claimed in claim 18, in which:

said receptacle means including a plurality of stops within the receptacle and said stops are spaced about the axis of rotation for being engaged by the respective teeth when the fully inserted teeth are turned into engagement in the receptacle.

20. In a rotary tool for use in a food processor, the improvement as claimed in claim 19, in which:

said stops are positioned for receiving the thrust of said teeth resulting from torque applied to the elongated hub by the tool drive means during operation of the food processor.

21. In a rotary tool having an elongated hub whose lower end is adapted for engagement with tool drive means in a food processor and whose upper end carries a generally horizontal disc-like member having food processing means thereon, said tool being rotated about an axis of rotation by said tool drive means during operation of the food processor, the improvement comprising:

a removable tool head including the disc-like member and receptacle means defining a receptacle having an entrance below said disc-like member, said receptacle means including a plurality of recesses communicating with said entrance and each being concentric with the axis of rotation, said elongated hub being removably mountable to said tool head, the upper end of said hub including a plurality of outwardly projecting circumferentially spaced teeth whose outer surfaces are each concentric with the axis of rotation, the upper end of said hub bing insertable into said entrance with said outwardly projecting teeth entering respective recesses, the hub thereafter being turnable relative to the tool head about the axis of rotation for turning said teeth into engagement in the receptacle, said receptacle means including a plurality of stops within the receptacle, said stops being spaced about the axis of rotation for being engaged by the respective teeth when the hub is turned into engagement in the receptacle, said stops being positioned for receiving the thrust of said teeth resulting from torque applied to the elongated hub by the tool drive means during operation of the food processor, and manually releasable locking means spring-biased for engagement between the hub and tool head when the teeth are turned into engagement against the stops for preventing the removal of the head from the hub unless the locking means are manually released.

22. A removable head rotary tool for use in food processors of the type having an upright working bowl in which said rotary tool is mounted for rotation about an axis within said bowl by motor drive means, a removable cover securable on said bowl for covering said bowl and said rotary tool during operation and a feed-tube for feeding food items to said rotary tool in said bowl, said removable head rotary tool comprising:

an elongated hub having an upper flange-like coupling member and a lower coupling portion adapted to be coupled to and rotated by said motor drive means, said flange-like upper coupling member having a plurality of spaced teeth extending from its periphery, a horizontal disc-like tool head having cutting means thereon for processing food items applied to said tool head, and receptacle means on the lower surface of said tool head, said receptacle means being open in the axial direction for accommodating the insertion of said flange-like coupling member in the axial direction into said receptacle means with limited rotational movement of said flange-like coupling member therein for removably mounting said tool head on said flange-like coupling member of said hub by inserting and turning said flange-like coupling member in said receptacle means, said receptacle means having a plurality of spaced clearance recesses for receiving said spaced teeth, with retainer lips betweem said clearance recesses, such that said spaced teeth enter said spaced recesses and are turned into said receptacle means for moving said teeth into snug engagement with said retainer lips, said flange-like upper coupling member having a movable rod extending upwardly therefrom, said movable rod being offset from the axis of rotation of said rotary tool, and said receptacle means having an upwardly extending locking recess therein offset from said axis adapted to receive said movable rod when said upper coupling member is properly positioned in said receptacle means, thereby preventing the inadvertent removal of said removable head from said hub when the end of said rod is in said locking recess, whereby other disc-like tool heads having different cutting structures for performing different food processing functions may be used on the same hub by changing tool heads without requiring a separate hub for each rotary tool.

23. A removable head rotary tool for use in food processors of the type having an upright working bowl in which said rotary tool is mounted for rotation about an axis within said bowl by motor drive means, a removable cover securable on said bowl for covering said bowl and said rotary tool during operation and a feed-tube for feeding food items to said rotary tool in said bowl said removable head rotary tool comprising:

an elongated hub having an upper flange-like coupling member and a lower coupling portion adapted to be coupled to and rotated by said motor drive means, said flange-like upper coupling member having a plurality of spaced teeth extending from its periphery, a horizontal disc-like tool having cutting means thereon for processing food items applied to said tool head, and receptacle means on the lower surface of said tool head, said receptacle means being open in the axial direction for accommodating the insertion of said flange-like coupling member in the axial direction into said receptacle means with limited rotational movement of said flange-like coupling member therein for removably mounting said tool head on said flangelike coupling member of said hub by inserting and turning said flange-like coupling member in said receptacle means, said receptacle means having a plurality of spaced clearance recesses for receiving said spaced teeth, with lip retainers between said clearance recesses, such that said spaced teeth are captured in said receptacle means when said teeth enter in said spaced recesses and turned into said receptacle means for moving said teeth into snug engagement with said lip retainers, said lip retainers each having a stop on their corresponding ends for limiting the circumferential movement of said spaced teeth as they are turned into engaged position with said lip retainers, and locking means for holding said teeth against the respective stops for preventing inadvertent removal of the tool head from the hub during operation, whereby other disc-like tool heads having different cutting structures for performing different food processing functions may be used on the same hub by changing tool heads without requiring a separate hub for each rotary tool.

24. The removable head rotary tool set forth in claim 23 in which:

said lip retainers and said spaced teeth are unevenly spaced with corresponding arrangement for preventing the improper insertion of said upper coupling member into said receptacle means.

* * * * *